US006962102B1

(12) United States Patent
Johnston et al.

(10) Patent No.: US 6,962,102 B1
(45) Date of Patent: Nov. 8, 2005

(54) ARMOUR CONSTRUCTIONS

(75) Inventors: Cameron Lindsay Johnston, Leicestershire (GB); Paul Stuart Leaman, W. Yorkshire (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 07/799,782

(22) Filed: Nov. 14, 1991

(30) Foreign Application Priority Data

Nov. 19, 1990 (GB) ..... 9025120

(51) Int. Cl.[7] ..... F41H 5/04
(52) U.S. Cl. ..... 89/36.17; 89/36.08
(58) Field of Search ..... 89/36.17, 36.02, 89/36.01, 36.08; 109/36, 37, 49.5

(56) References Cited

U.S. PATENT DOCUMENTS 4,741,244 A * 5/1988 Ratner et al. ..... 89/36.17

FOREIGN PATENT DOCUMENTS

| | | | |
|---|---|---|---|
| FR | 2368598 | * 5/1978 | ..... 89/36.17 |
| FR | 2380528 | * 9/1978 | ..... 89/36.17 |
| GB | 1581125 | * 12/1980 | ..... 89/36.17 |

* cited by examiner

*Primary Examiner*—Stephen M. Johnson
(74) *Attorney, Agent, or Firm*—Nixon & Vanderhye P.C.

(57) ABSTRACT

An applique armour panel for fitting to a substrate and for protecting the substrate from missile or other projectile attack which panel comprises an exterior plate (1), an interior plate (4) and a layer or layers (7) of explosive material therebetween. The explosive material is detonated by an incoming missile to cause disruption of the incoming missile and reduce its penetrative effect. The panel is constructed so that upon reactive explosion the interior and exterior plates are driven apart more rapidly at one edge of the panel than at an opposite edge by a rotating moment of one plate relative to the other.

14 Claims, 15 Drawing Sheets

18
19
2
1
11
5
17
15
21
14
16
9
3
7
10
4
13
12
6
8

X
1
18
8
11
9
12

18
11
17
21
19
8
15
14
1
4
9
12
16
7
6

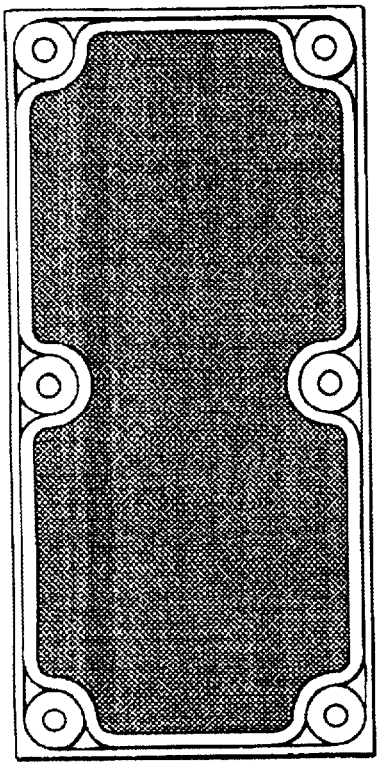
Fig. 30.
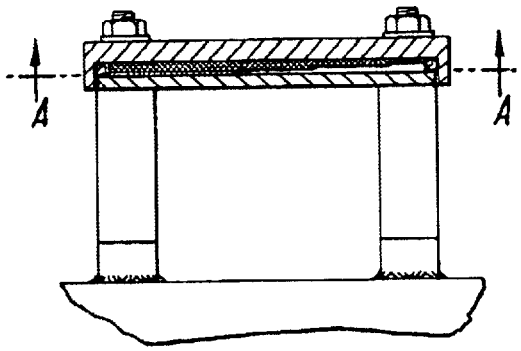
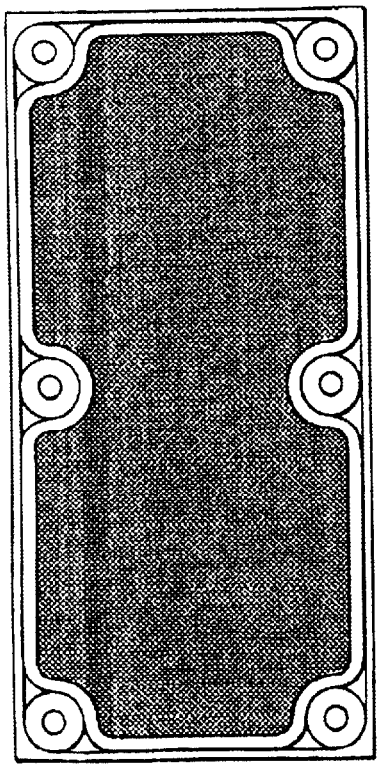
Fig. 32.
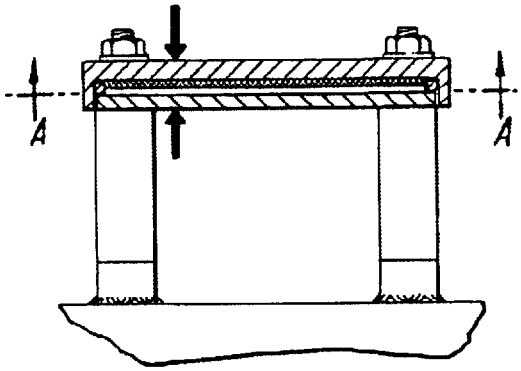

ARMOUR CONSTRUCTIONS

BACKGROUND OF THE INVENTION

1. Field of the Invention

This invention relates to armour constructions and particularly to explosive reactive armour panel arrays that can be fixed at pre-determined locations on the outer surface of an armoured fighting or military vehicle, or other structure to be protected, to provide an additional protective layer around the outer surface of the vehicle or structure. Armour panels that can be mounted on an existing armoured vehicle or other existing structure are generally referred to as applique armours.

2. Discussion of Prior Art

Explosive reactive armour (ERA) comprises a protective construction having an explosive material which is detonated by the impact of an incoming projectile or missile to cause an explosion which reduces the penetrative effect of the projectile or missile. Usually the explosive material is located between metal plates which are driven apart by the explosion and it is the movement of these plates relative to the line of attack which has a beneficial effect on reducing the penetration of the projectile or missile.

Explosive reactive armour is particularly effective in defeating projectiles which have a hollow shaped charge warhead. Such warheads usually comprise a metal-lined cone (usually copper) embedded at the forward end of a high explosive (HE) charge, which is detonated upon target impact, causing the metal to form into a long high velocity semi-molten or plasma jet. The impact of this high-speed jet on conventional vehicle integrated armour such as rolled homogenous armour (RHA) is to produce pressures which are substantially greater than the yield strength of the armour material, allowing hydro dynamic penetration of the armour.

When an incoming shaped charge warhead strikes explosive reactive armour at an oblique angle of attack, the movement of the metal plates across the line of the jet acts to erode and disrupt the jet, which thereby loses much of its penetrative effect.

SUMMARY OF THE INVENTION

It has been found that a panel which is assembled so that the reactive explosion is greater at one edge of the panel than the opposite edge and/or so that the interior and exterior armour plates are restrained so that they are forced apart with a "peeling" effect by the reactive explosion has, when the panels is correctly mounted in use, advantages over known applique armour panels. One advantage of the present invention is that more reactive armour material is introduced into the shaped charge jet and the erosion of the jet is thereby increased on a weight by weight basis. Another known advantage of the present armour panel construction is that the semi-molten or plasma jet is deflected from its original attack angle reducing the ultimate angle of incidence.

The present invention provides an applique armour panel for fitting to a substrate and for protecting the substrate from missile or other projectile attack, which panel comprises an exterior plate, an interior plate and a layer of explosive material therebetween which explosive material is adapted to be detonated by an incoming missile or other projectile to cause the panel to disrupt the incoming missile or other projectile to reduce the penetrative effect thereof, the assembly of the panel being such that upon reactive explosion the interior and exterior plates are driven apart more rapidly at one edge of the panel than at an opposite edge by a rotating moment of one plate relative to the other thereby to enhance the disruptive effect upon the incoming missile or other projectile.

According to a feature of the invention restraining means may be provided to restrain the interior and exterior plates against being driven apart to a lesser degree at said one edge than at said opposite edge.

According to another feature of the invention the layer of explosive material may be substantially coextensive with the juxtaposed faces of said interior and exterior plates. In some constructions where such a full layer of explosive material is provided the layer of explosive material may be tapered so that it decreases in thickness in a direction extending from said one edge towards said opposite edge. In other constructions where such a full layer of explosive material is provided the layer of explosive material may be perforate, and in which the size of the perforations are graded so that they are of increased size in a direction extending away from said one edge towards said opposite edge. Preferably, the perforations are graded in rows.

In yet other constructions where a full layer of explosive material is provided an additional layer of explosive material may be superposed upon the first mentioned layer of explosive material so as to at least partially cover said first mentioned layer. In some panel assemblies the additional layer of explosive material may be perforate, and preferably the size of the perforations in said additional layer of explosive material are graded so that they are of increased size in a direction extending away from said one edge towards said opposite edge.

In other panel assemblies having an additional layer the additional layer of explosive material may be in the form of discrete strips, and preferably said strips are graded so that they are of decreasing width in a direction extending away from said one edge towards said opposite edge.

In some preferred panel assemblies the additional layer of explosive material may be of chevron shape in which the base of the chevron is disposed adjacent said one edge and the apex of the chevron extends towards, but stops short of, or is disposed adjacent said opposite edge.

According to yet another feature of the invention said panel may be substantially rectangular in shape and said one edge is a transverse edge of the panel or alternatively the said one edge may be a longitudinal edge of the panel.

BRIEF DESCRIPTION OF THE DRAWINGS

Applique armour panel assemblies embodying the present invention will now be described by way of example with reference to the accompanying drawings, in which:

FIG. 30 is a similar assembly to FIG. 29, but shows a layer of explosive material tapered over its width, shaded;

FIG. 32 is a similar assembly to FIG. 31, but shows the exterior and interior plates mechanically restrained, towards one side.

DETAILED DISCUSSION OF PREFERRED EMBODIMENTS

Figure 1:
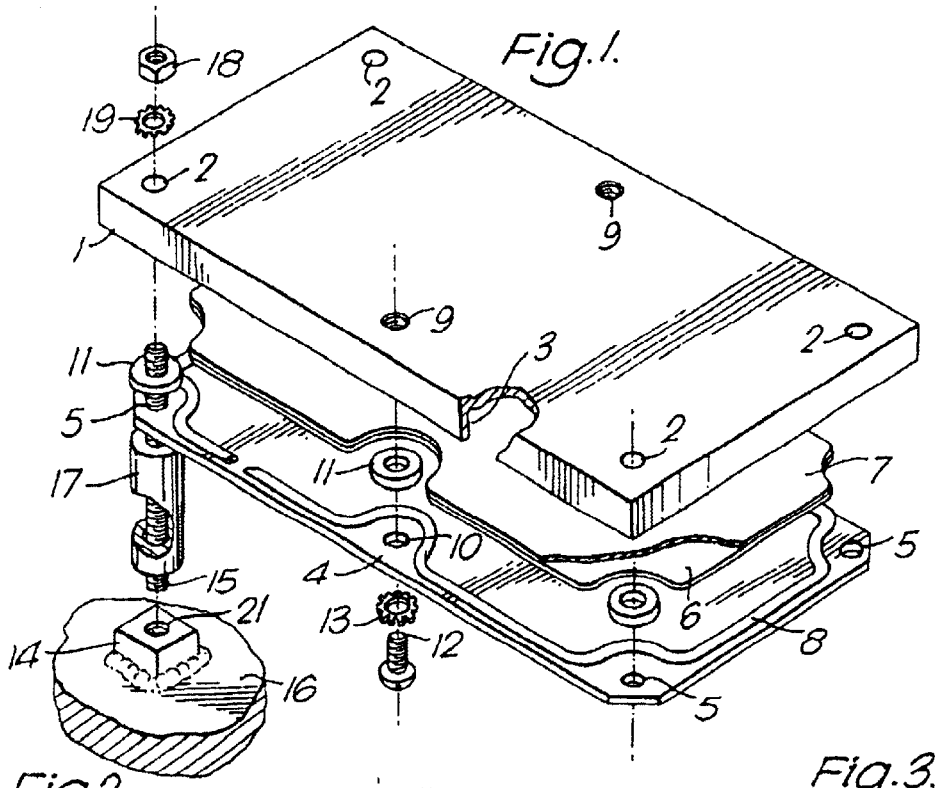
FIG. 1 is an exploded isometric view of an ERA panel according to the present invention which also illustrates the means of fixing the panel to a parent armour such as may be found in an armoured fighting vehicle.
Figure 2:
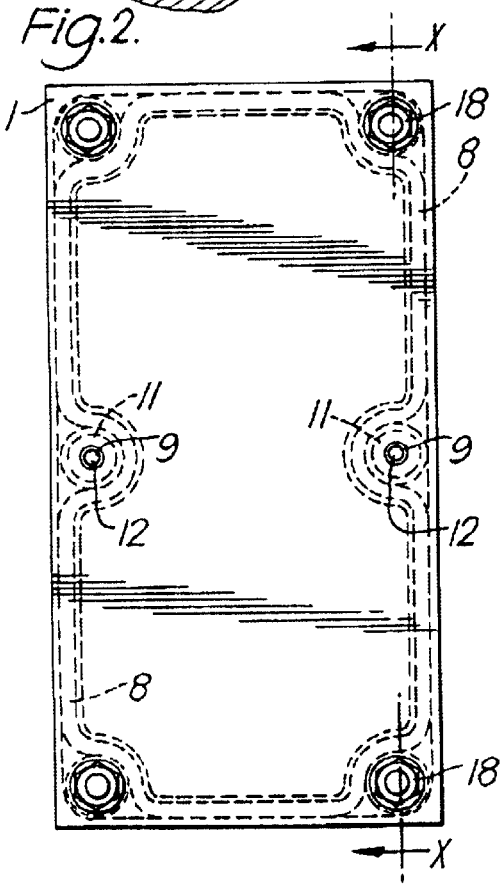
FIG. 2 is a top view to a different scale of the ERA panel illustrated in FIG. 1.
Figure 3:
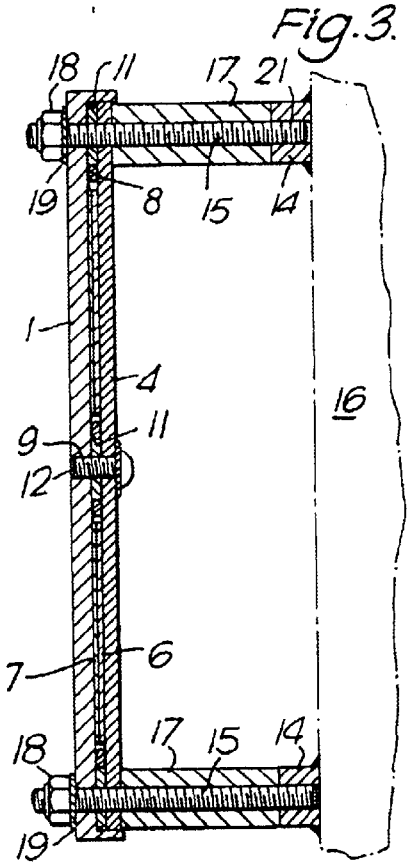
FIG. 3 is a section along the line XX in FIG. 2.
Figure 4:
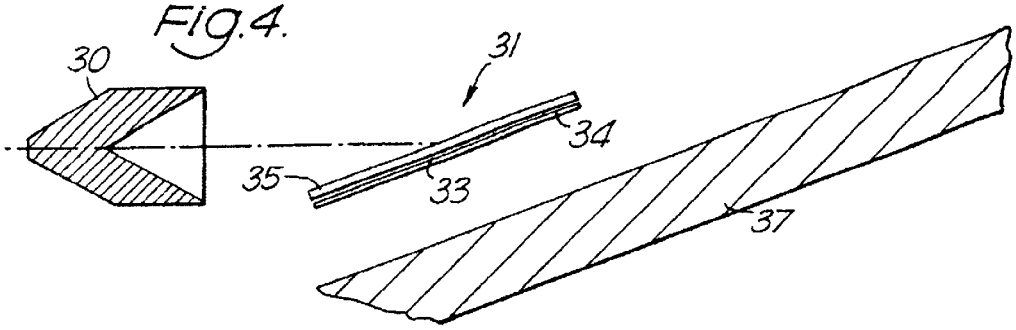
FIGS. 4 to 7 illustrate in diagrammatic form the action of a shaped charge warhead striking an explosive reactive armour panel at an oblique angle of attack.

The ERA panel shown in FIG. 1–3 has a rectangular exterior plate 1 having four holes 2, one at each corner extending through the complete thickness of the exterior plate 1. The plate 1 has two additional holes 9 which are screw threaded and are located one each at the centre point of the two longer sides of the rectangular exterior plate 1. The plate 1 has an inward rim 3 around its entire edge, which extends perpendicular to the plane of the exterior plate 1 to form a recess on the inside surface of the plate 1. An interior plate 4 which is substantially rectangular with chamfered corners, is of a size such that it is an easy sliding fit within the rim 3 of the exterior plate 1.

The interior plate 4 has four holes 5 and two holes 10, which are in the same configuration and correspond exactly with the holes 2 and 9 respectively in the exterior plate 1 when the interior plate 4 is fitted within the rim 3.

FIG. 1 shows an approximately rectangular layer of explosive material 6 located between the interior and exterior plates 4 and 1 respectively. However, in some embodiments of the invention described below an additional layer of explosive material is superposed to cover, at least partially, the first layer 6. A rectangular packing spacer 7 of suitable compressible foam material is positioned between the explosive layer or layers 6 and the exterior plate 1 to accommodate any irregularities in the surfaces of the plates 1 and 4 or explosive layer or layers.

Between the explosive layer or layers 6 and the interior plate 4 is positioned a sealing ring gasket 8 which when assembled and fixed together protects the explosive layer or layers from ingress of water or other potential contaminants.

The packing spacer 7, explosive layer or layers and gasket 8 are shaped at the corners and at the mid-point of the longer rectangular side of the ERA panel in the way illustrated to accommodate the means for fixing the elements of the panel together and the means for mounting the panel on a substrate which are both described below.

The exterior plate 1, interior plate 4, packing spacer 7, explosive layer or layers and ring gasket 8 may be fixed together to form an ERA panel by means of screws 12 which are inserted through the holes 10 and screwed into the screw threaded holes 9 at the mid-point of each of the longer sides of the exterior plate 1. Ring spacers 11 are inserted between the interior and exterior plates 4 and 1 respectively to avoid crushing of the explosive layer 6 when the screw 12 is tightened. Also a locking washer 13 is located between the head of the screw 12 and the interior plate 4.

The means for fixing each ERA panel to the parent armour, for example to the glacis (inclined) turret surface of a main battle tank, comprises four mounting bosses 14, each having a screw threaded hole 21 at its centre and each of which is welded to the parent armour 16. The four mounting bosses 14 are mounted on the parent armour surface in a rectangular spaced formation which corresponds with the rectangular formation of the four holes 2 and 5 in the exterior and interior plates 1 and 4 respectively. Four studs 15 which are screw threaded at least at each end are screwed one each into the mounting bosses 14 and thereby extend perpendicularly from the parent armour. Similar hollow cylindrical spacer tubes 17 are located one each over the four studs 15 which are of a diameter less than the diameter of the corresponding holes 5 and 2. The four pairs of corresponding holes 2 and 5 in the exterior and interior plates 1 and 4 respectively fit over the corresponding studs 15 and the ERA panel is located in a position spaced away from the parent armour by the spacer tubes 17. The ERA panel is fixed to the parent armour 16 by nuts 18 and locking washers 19 which screw down each of the studs 15 at each corner of the ERA panel. Ring spacers 11 are positioned between the exterior and interior plate.

In the manner described the exterior and interior plates 1 and 4 respectively are fixed with the layer or layers of explosive material therebetween by means of screws 12 which pass through the interior plate 4 and screw into the holes 9 in the exterior plate 1. The means for mounting the ERA panels on the parent armour 16 also acts to fix the panel together.

The exterior and interior plates 1 and 4 respectively are of a high density steel to BS Specification 1449, which gives good ductiliy and fracture toughness properties.

The explosive layer or layers comprise Demex 200 which is a polymer bonded RDX based explosive which is particularly insensitive. The material is marketed by Royal Ordnance plc in sheet form or thickness between ⅛ of an inch to ¼ of an inch.

The best results in defeating shaped charged warheads are obtained by mounting the ERA panels so that the incoming projectile strikes the panel at an oblique angle of attack. In FIGS. 1–3, the ERA panel is mounted parallel to the parent armour which is particularly suitable for protecting the glacis parent armour structure of a main battle tank which is generally inclined such that an incoming shaped charge warhead will strike the glacis structure at an oblique angle of attack. However, by using spacer tubes of different lengths it is possible to mount the ERA panels at an angle to the glacis structure.

Figure 8:
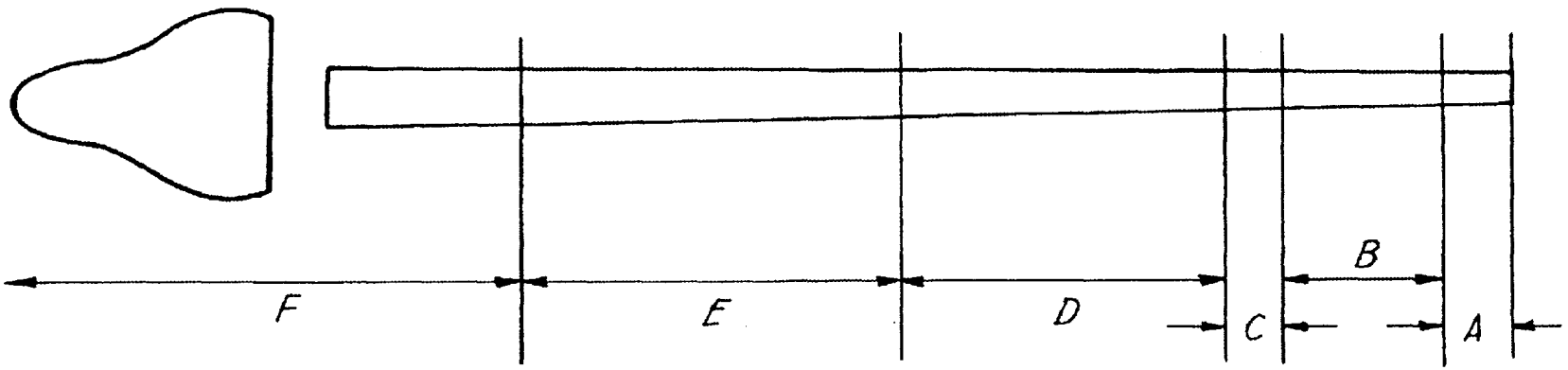
FIG. 8 is a diagrammatic illustration of how a shaped charged jet is affected by an exploding ERA panel.

FIGS. 4–7 give a diagrammatic representation only of the operation of an ERA panel according to the invention which is struck centrally by a shaped charge warhead 30 and FIG. 8 is a diagrammatic representation of how a shaped charge jet is affected by impact with an ERA panel.

Figure 5:
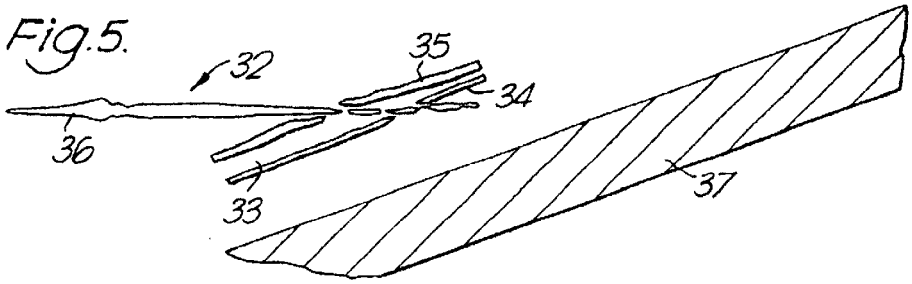
Figure 6:
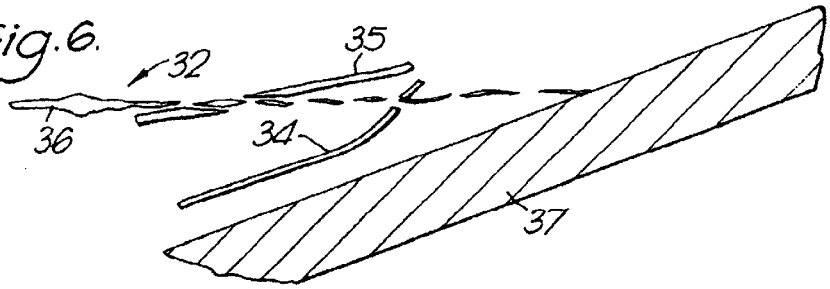
Figure 7:
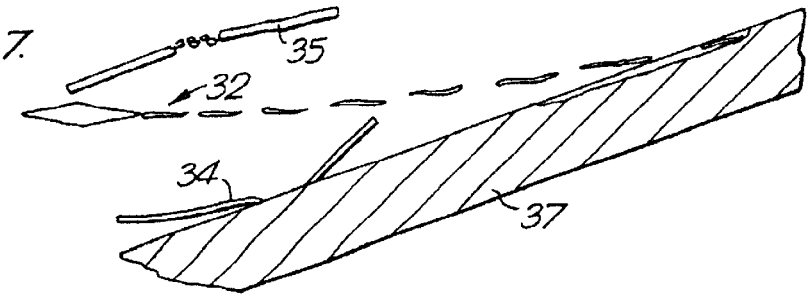

Detonation of the HE explosive upon impact with an ERA panel 31 causes the metal-lined cone to form into a long high velocity molten jet 32 (FIG. 5). A portion of the front tip of the jet (A in FIG. 8) is consumed in the impact with the ERA panel by the hydrodynamic penetration of the jet through the ERA panel and a length B of the jet escapes through the panel to attack the parent armour. A length C of the ERA panel is disrupted by the force of the explosion of the explosive layers 33. As a result of the explosion the interior plate 34 is driven forward with a component movement in the direction of the movement of the jet and is referred to as a forward moving plate.

Initial movement of the part of the forward moving plate which is in the vicinity of the detonation of the explosive layer or layers 33 is in a direction substantially perpendicular to the plane of the ERA panel. Additional plate material is thereby forced into the shaped charged jet to disrupt the jet and to consume length D of the jet. This disruption continues even when the forward moving plate 34 is substantially distorted (FIG. 6) as long as material from the forward moving plate continues to be driven into the shaped charge jet.

The exterior plate which becomes the backward moving plate 35, upon detonation of the explosive layer 33, acts in a similar manner to the forward moving plate 34 except that its initial movement is perpendicular to the plane of the ERA panel in a direction opposite to the direction of initial motion of the forward moving plate 34. The "peeling" effect produced by the rotating moment of the backward moving plate 35 drives more plate material into the jet than a standard ERA panel and a length of the jet indicated by D and E in FIG. 8 is disrupted and partially consumed. In addition the backward moving panel deflects the jet from its original attack angle reducing the ultimate angle of incidence. The rear-most length of the jet F including the slug 36 may pass, basically unaffected by the exploding reactive armour panel, to strike the parent armour 37.

In this manner a substantial portion of the length of a shaped charge jet can be eroded or disrupted, such as to substantially reduce the penetrative effect of the shaped charge warhead.

The actual and relative values of the lengths A to F of the jet that will be eroded, disrupted or consumed will in practice depend upon a number of parameters, but analysis has shown that in a given unit of time, the backward moving plate is driven through a greater length of the jet than is the forward moving plate. A better disruptive effect of the jet as a whole has been experienced by having a backward moving plate which is of greater thickness than the forward moving plate.

The rotating moment of the backward moving plate which causes the plate to move apart more rapidly along one edge of the panel than at the opposite edge can be achieved in a number of ways.

For example, in the embodiments illustrated in FIGS. 9 to 16 each panel assembly includes a full layer of explosive material shown in light shading and a chevron shaped additional layer of explosive material superposed on the full layer and shown in darker shading. In some of the assemblies such as those shown in FIGS. 9 to 12 the base of the chevron extends along a transverse edge and the apex of the chevron is directed towards the opposite transverse edge of the panel. In the embodiments shown in FIGS. 9 and 10 the apex of the chevron stops short of the opposite edge of the panel but extends to that opposite edge in the embodiments shown in FIGS. 11 and 12.

Figure 9:
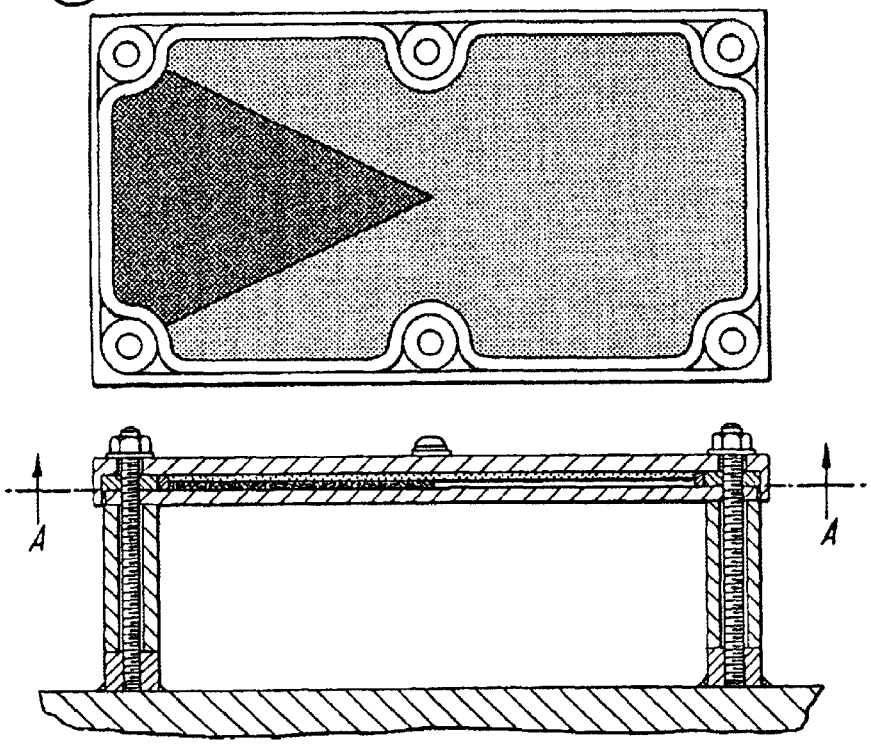
FIG. 9 is an assembly view of an ERA panel, showing a full layer of explosive material lightly shaded, with a chevron shaped layer of explosive material shown darker, and illustrating the means of fixing the panel to a parent armour, such as may be found in an armoured fighting vehicle.
Figure 10:
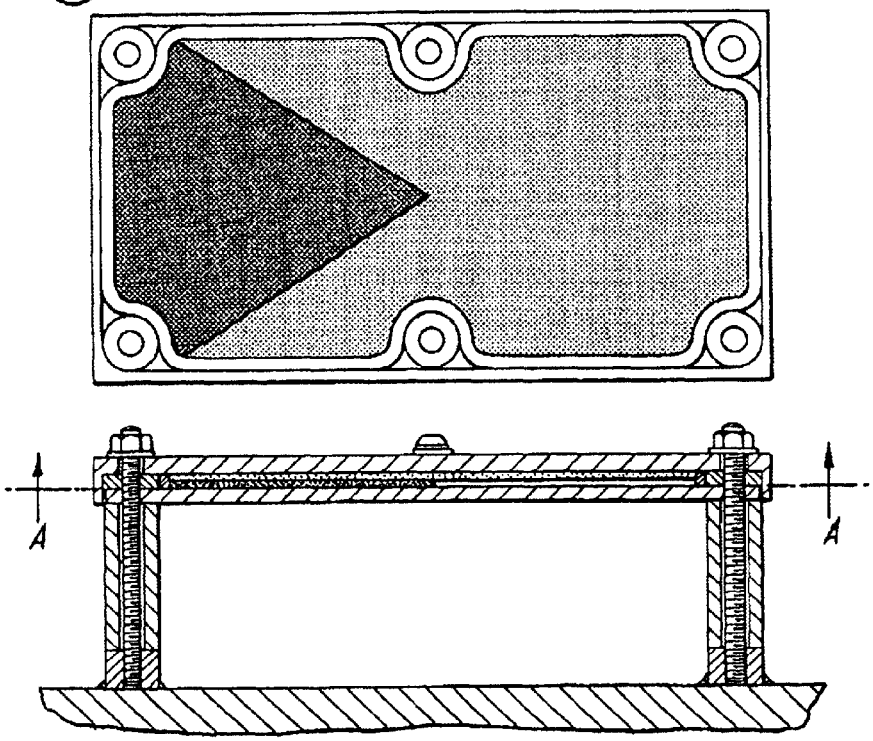
FIG. 10 is a similar assembly view to FIG. 9 but shows the chevron shaped layer of explosive material with a broader base extending along a transverse edge of the panel.
Figure 11:
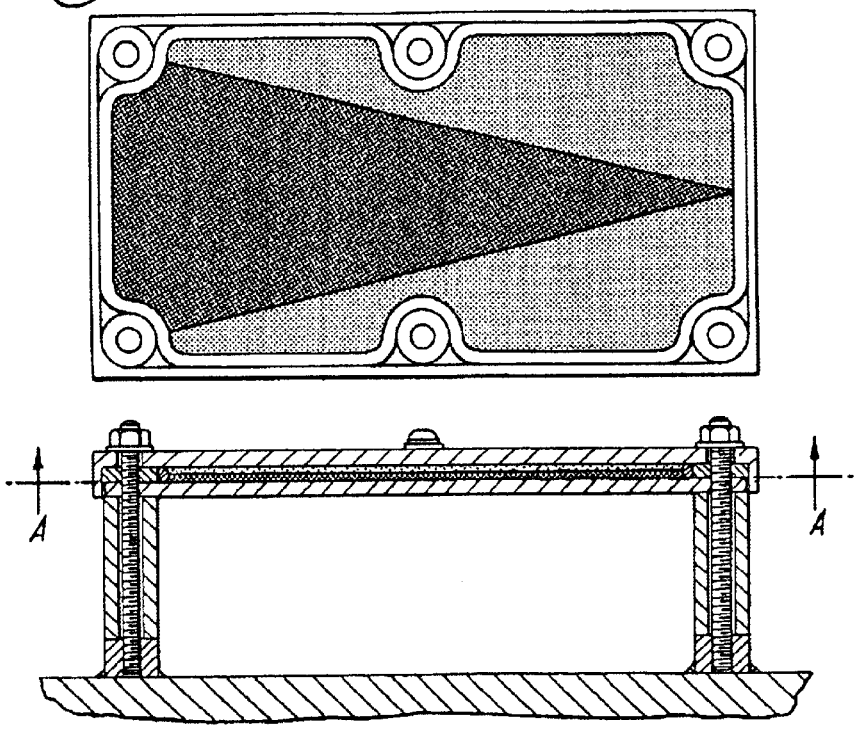
FIG. 11 is an assembly view of an ERA panel, showing a full layer of explosive material lightly shaded, with a full length chevron shaped layer of explosive material shown darker and having its base extending along a transverse edge of the panel.
Figure 12:
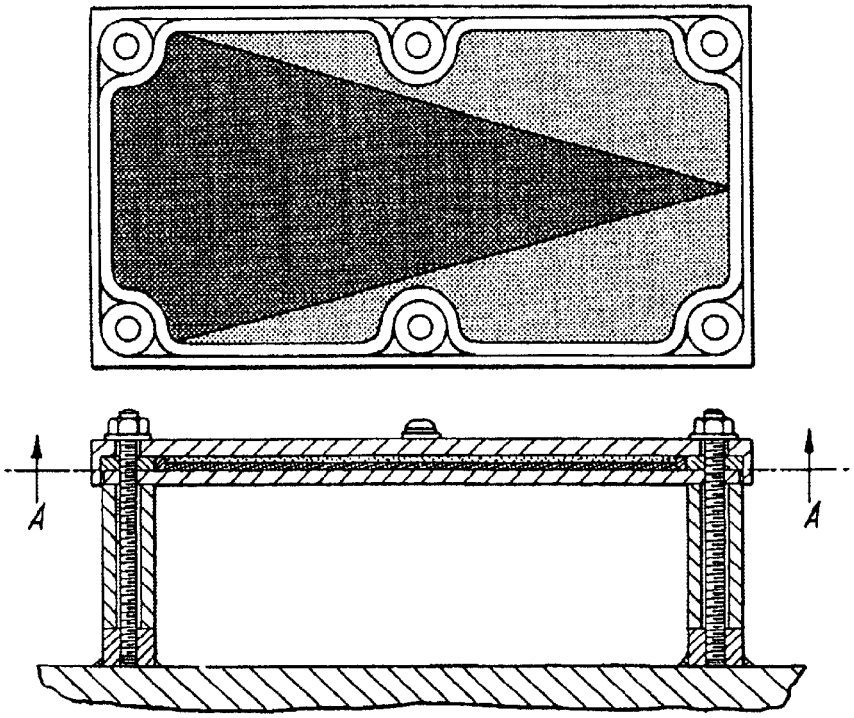
FIG. 12 is a similar assembly view to FIG. 11, but shows the chevron shaped layer of explosive material with a broader base extending along a transverse edge of the panel.
Figure 13:
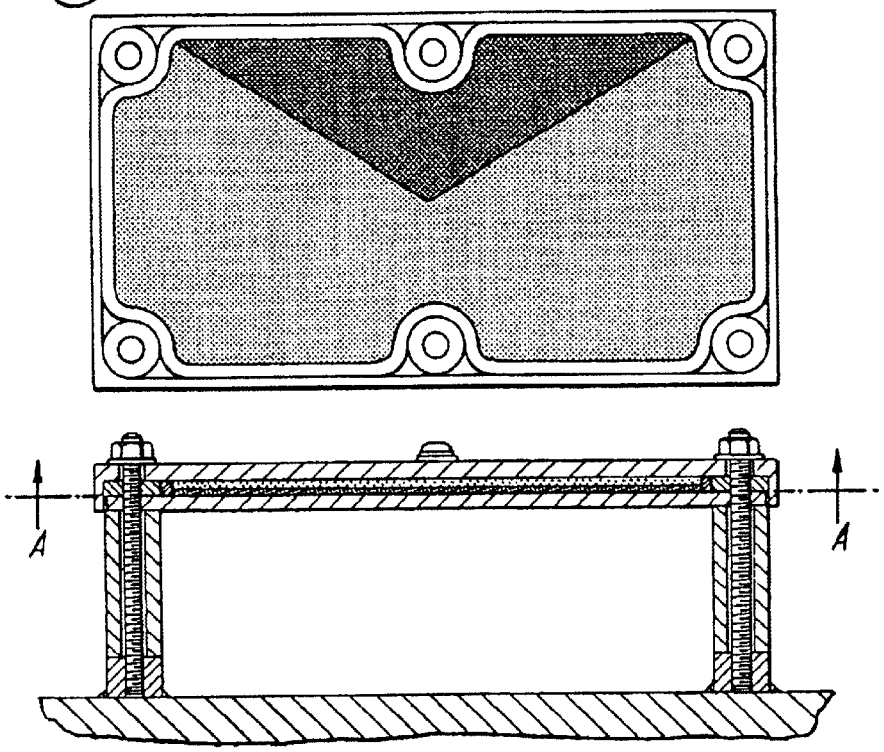
FIG. 13 is an assembly view of an ERA panel, showing a full layer of explosive material lightly shaded, with a chevron shaped layer of explosive material shown darker and having its base extending along a longitudinal edge of the panel.

Tests indicate that the most effective configuration for reactive armour other than that required for top attack protection is the embodiment illustrated in FIG. 9 where, in use, the panel would be mounted as shown in FIGS. 4 to 7 with the base of the chevron at the lowermost edge of the panel. The additional explosive imparts a higher acceleration to the lower edge of the plates so that upon reactive explosion the interior and exterior plates are driven apart more rapidly at the lower edge than at the opposite upper edge by a rotating moment of one plate relative to the other. The disruptive effect is thereby enhanced because more reactive armour material is introduced into the shaped charge jet and erosion of the jet is increased on a weight by weight basis and, moreover, the jet is deflected from its original attack angle reducing the ultimate angle of incidence.

Figure 14:
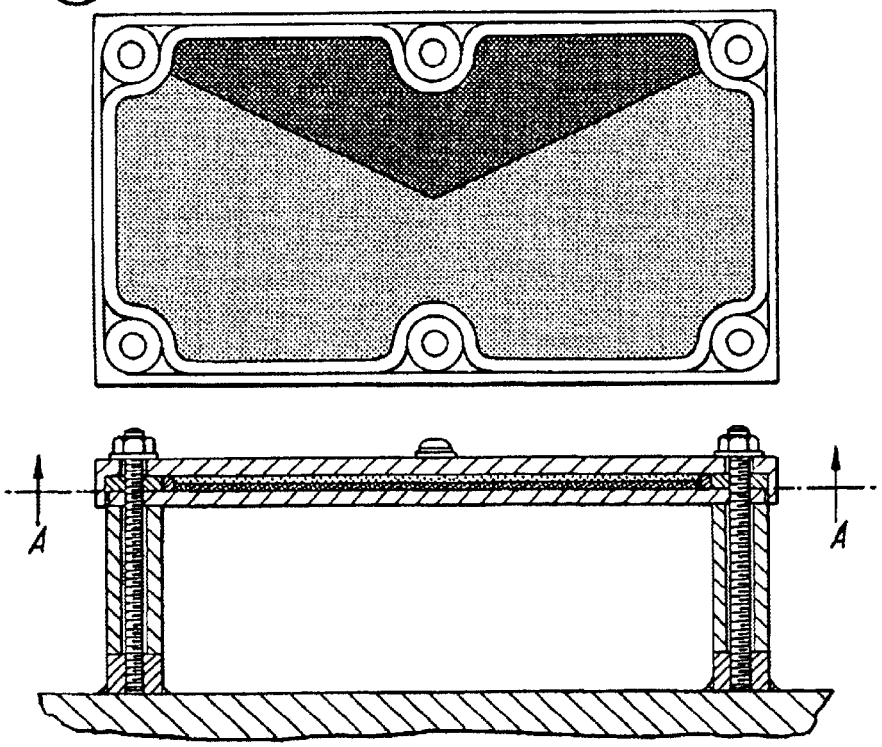
FIG. 14 is a similar assembly view to FIG. 13 but shows the chevron shaped layer of explosive material with a broader base extending along a longitudinal edge of the panel.
Figure 15:
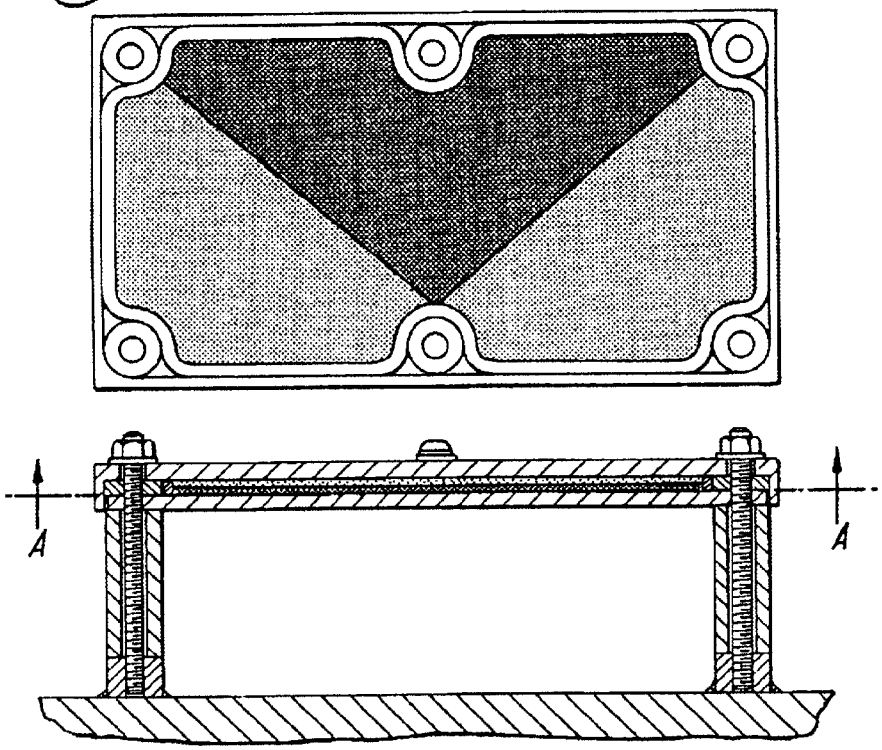
FIG. 15 is a similar assembly view to FIG. 13, but shows a full width, chevron shaped layer of explosive material.
Figure 16:
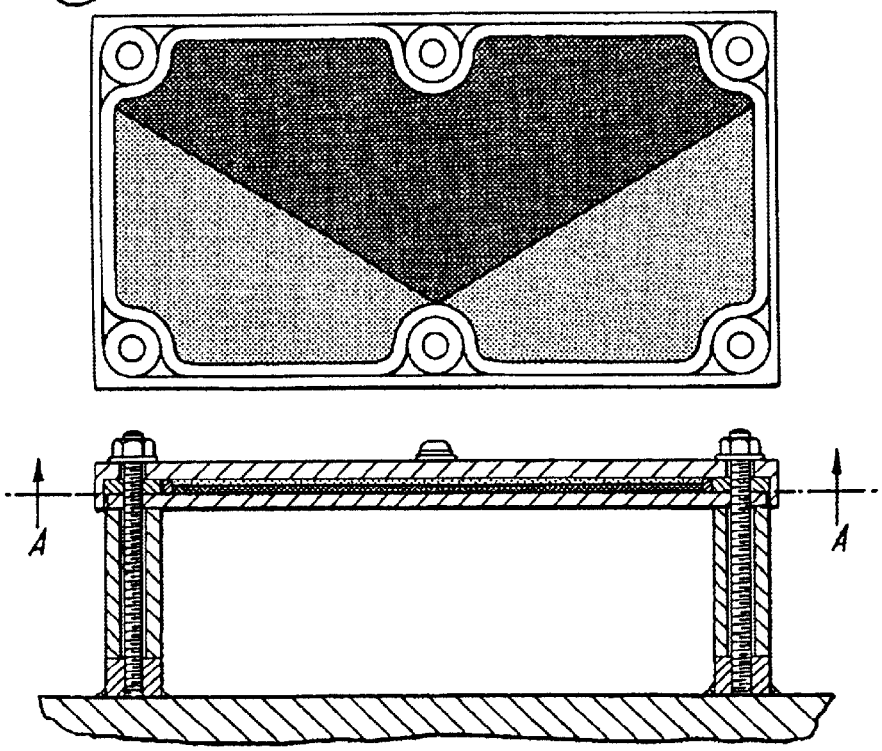
FIG. 16 is a similar assembly view to FIG. 15, but shows the chevron shaped layer of explosive material with a broader base.
Figure 17:
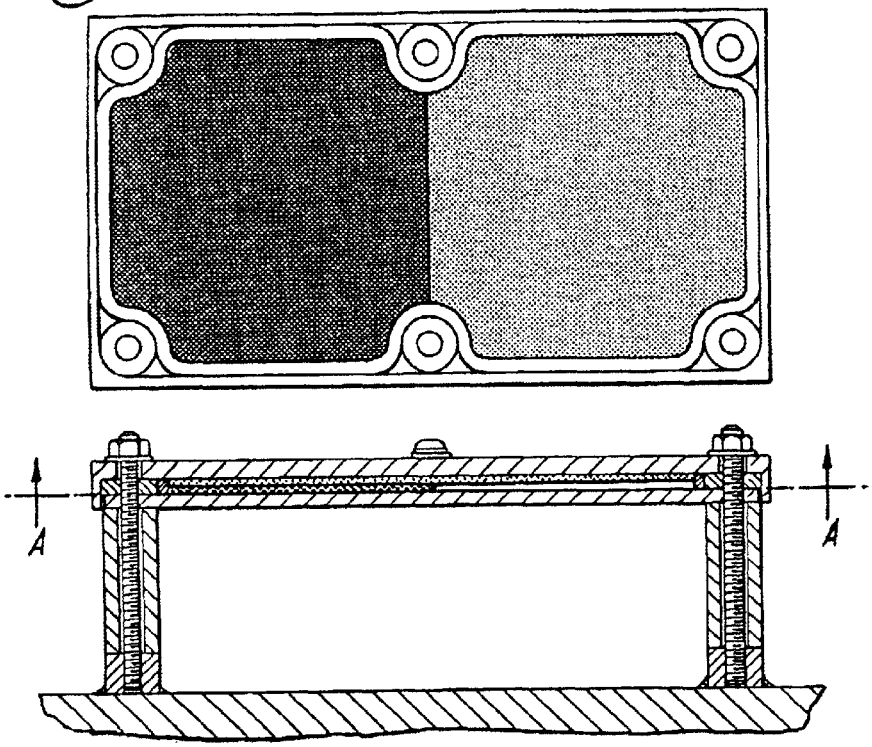
FIG. 17 is an assembly view of an ERA panel, showing a full layer of explosive material lightly shaded, with a half length layer of explosive material shown darker.
Figure 18:
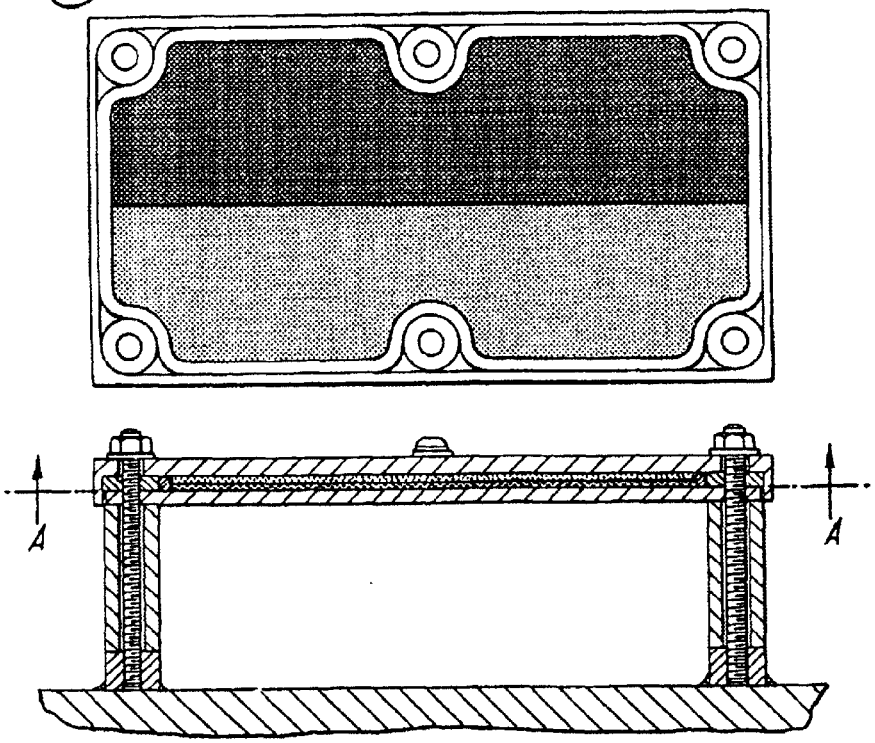
FIG. 18 is a similar assembly view to FIG. 17, but shows a half width layer of explosive material.
Figure 19:
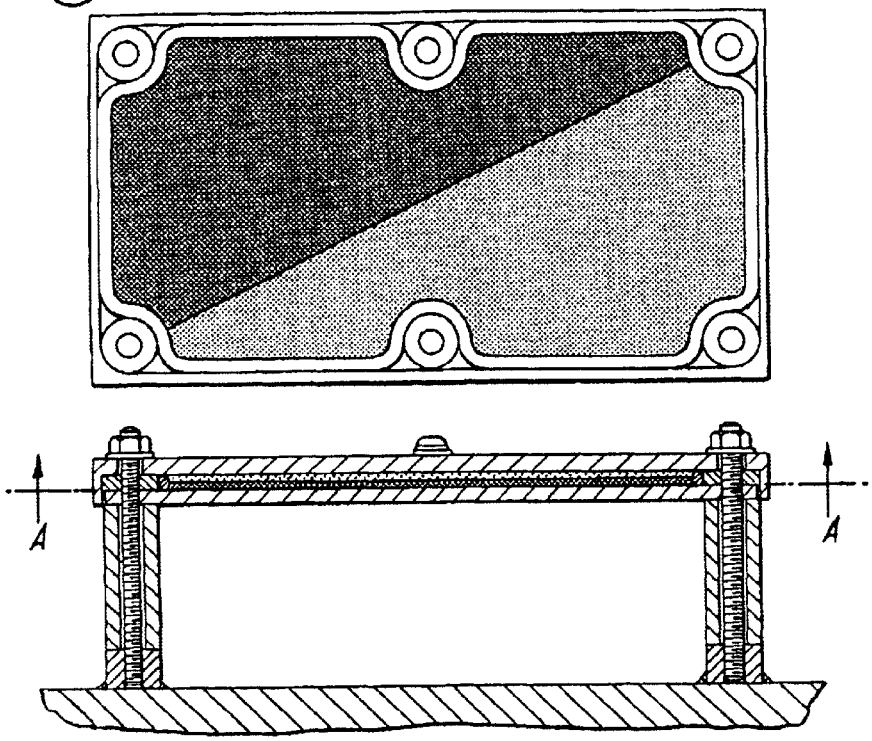
FIG. 19 is an assembly view of an ERA panel, showing a full layer of explosive material lightly shaded, with a further half layer of explosive material shown darker.

The panel assemblies shown in FIGS. 13 to 16 are suitable reactive armour arrangements for protection against top attack and the embodiment shown in FIG. 14 in trials has been found to be the most effective. Other reactive armour arrangements for protection against top attack are those embodiments illustrated in FIGS. 18, 19, 23 to 25, 28, 30 and 32 whereas armour arrangements for protection other than top attack protection are illustrated in FIGS. 9 to 12, 17, 20 to 22, 26, 27, 29 and 31.

In all of the specific examples shown in FIGS. 9 to 16 the proportional thickness of the exterior plate, the explosive material in the chevron area and the interior plate are in the ratios 8:6:6 or 8:6:2 and the armour is referred to as having an 8:6:6 or 8:6:2 recipe, respectively.

Figure 20:
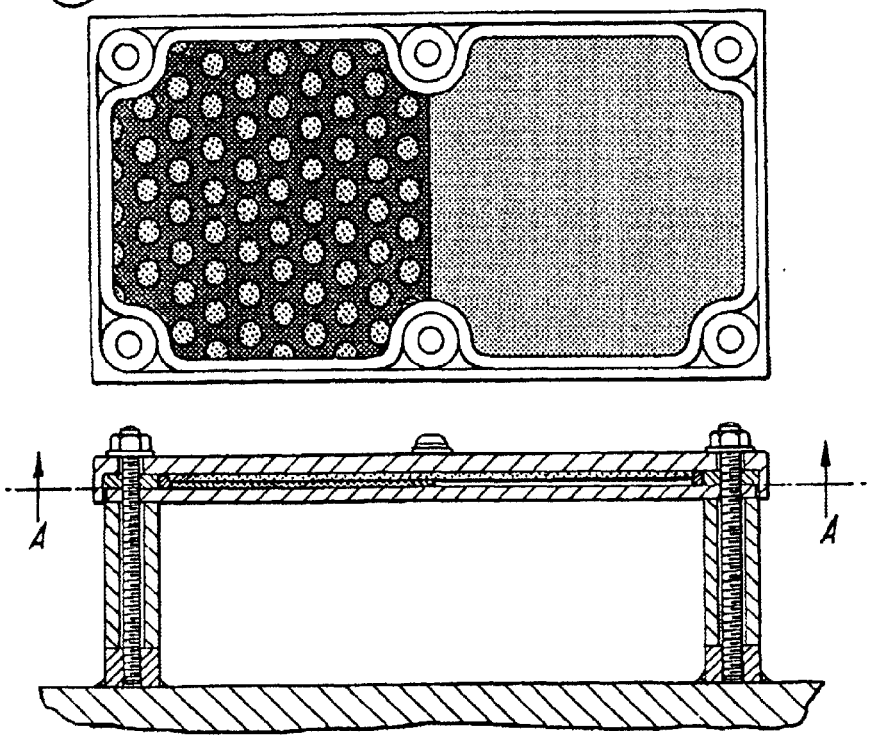
FIG. 20 is an assembly view of an ERA panel, showing a full layer of explosive material lightly shaded, with a perforate half layer of explosive material shown darker.
Figure 21:
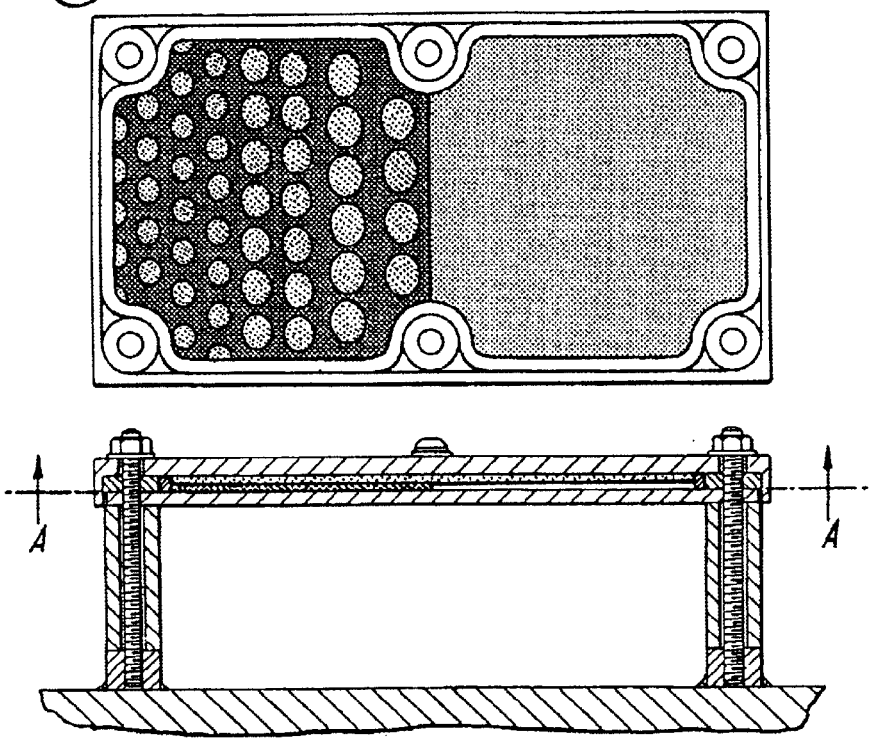
FIG. 21 is a similar assembly view to FIG. 20 but shows a graded series of perforations in the perforate half layer of explosive material.
Figure 22:
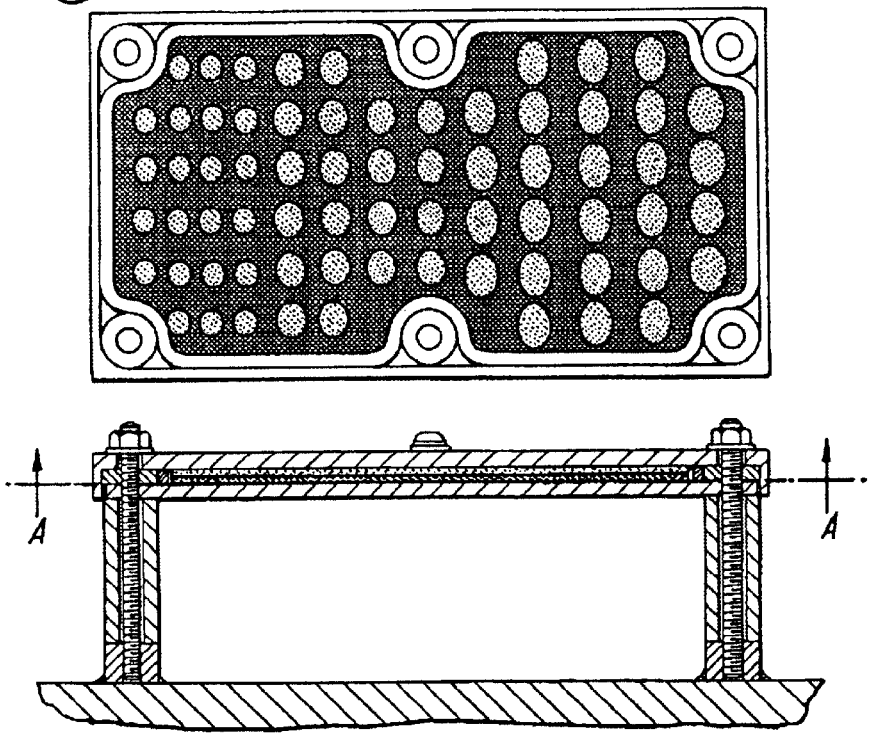
FIG. 22 is a similar assembly view to FIG. 21, but has a second full layer of explosive material, with graded perforations.
Figure 23:
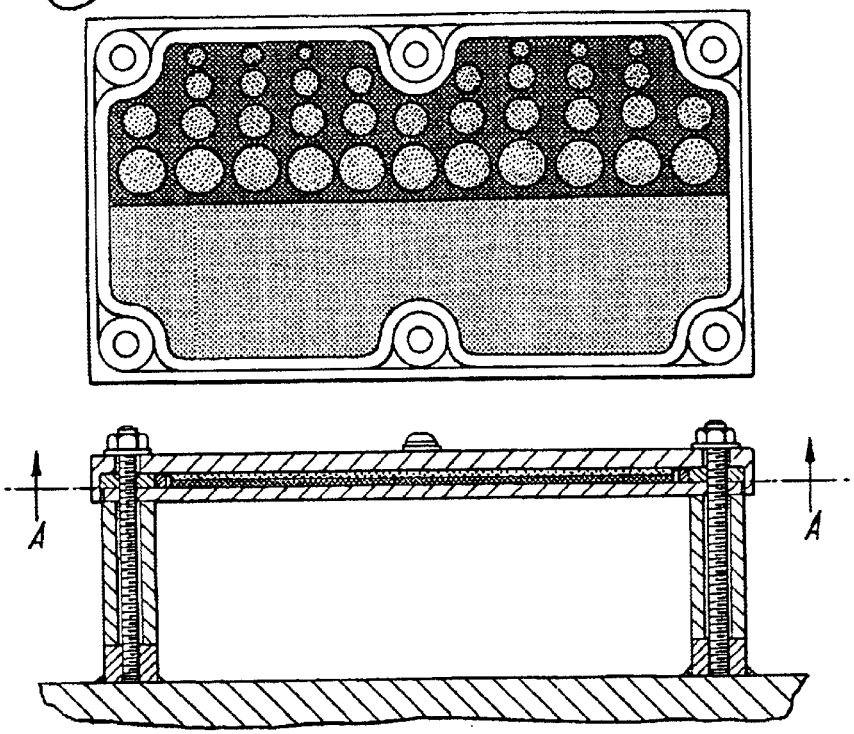
FIG. 23 is an assembly view of an ERA panel, showing a full layer of explosive material lightly shaded with a further half layer of explosive material with graded perforations
Figure 24:
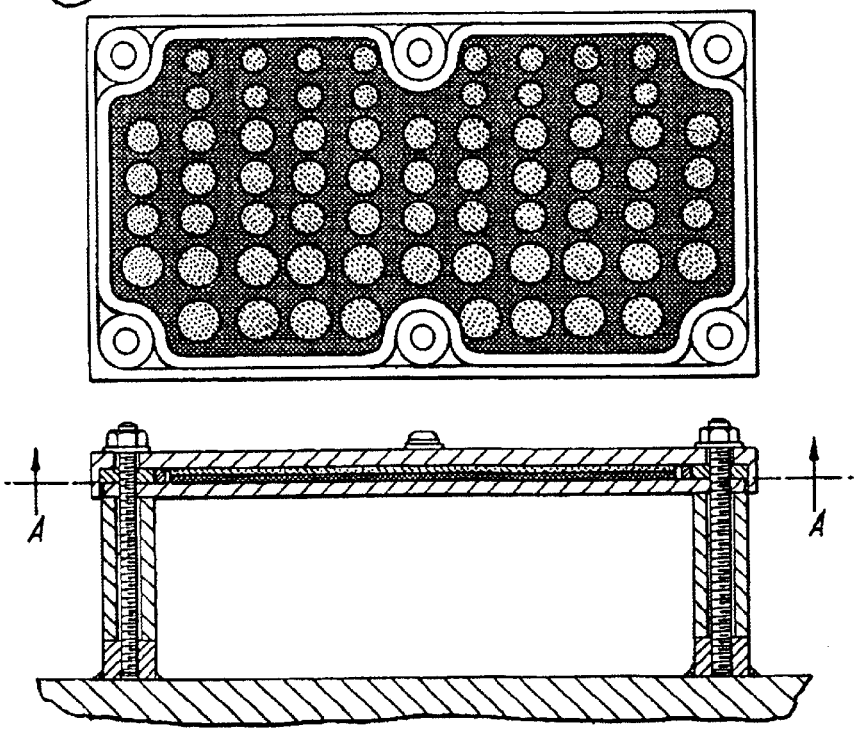
FIG. 24 is a similar assembly view to FIG. 23, but with a second full layer of explosive material with graded perforations, shown darker.
Figure 25:
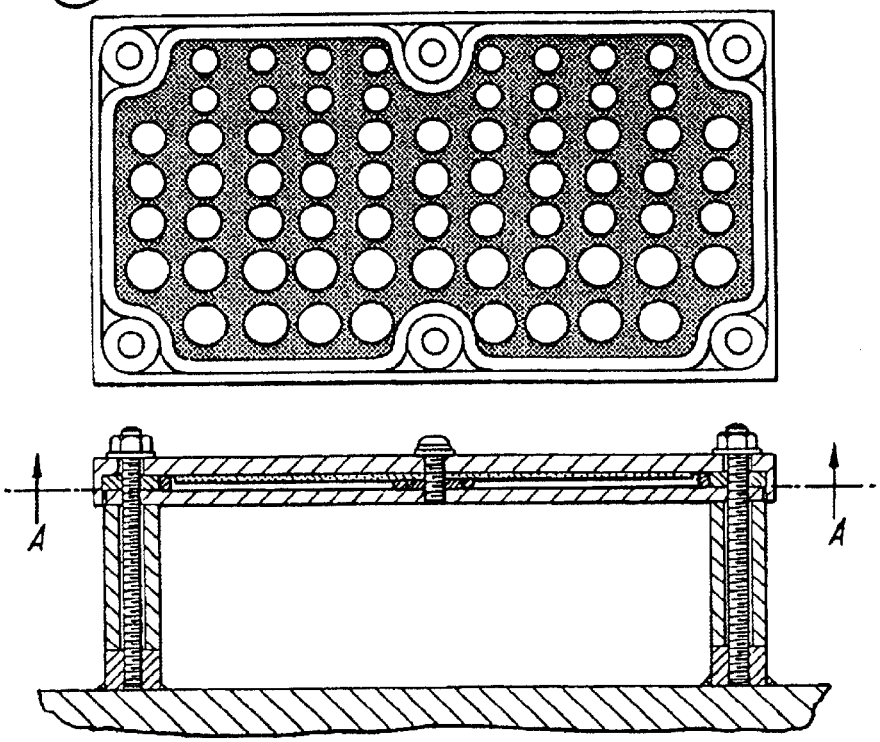
FIG. 25 is an assembly view of an ERA panel, showing a layer of explosive material, shaded, with size graded perforations, across its width.
Figure 26:
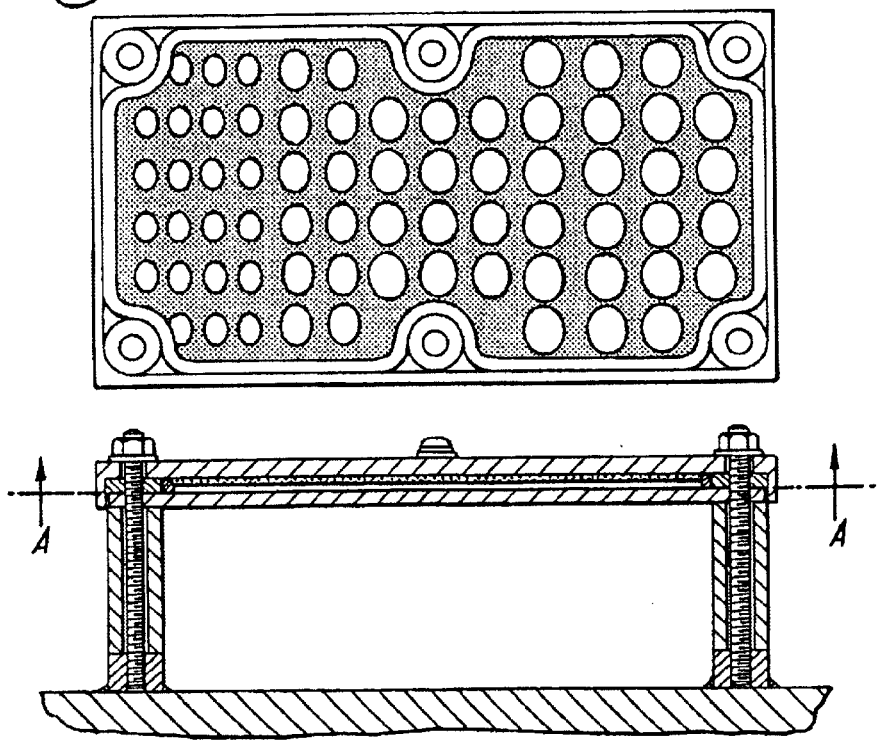
FIG. 26 is a similar assembly view to FIG. 25, but shows the layer of explosive material, shaded, with size graded perforations along its length.

In the embodiments shown in FIGS. 17 to 21 each panel assembly includes a full layer of explosive material shown in light shading and an additional layer, having approximately half the plate area, of explosive material superposed on the full layer shown in darker shading. In FIGS. 20 and 21 the additional layers are perforate and in the specific arrangement of FIG. 21 the perforations are graded in rows so that the diameter of the perforations is gradually increased from one transverse edge of the panel towards the centre of the panel.

FIGS. 22 to 26 illustrate further embodiments where at least one layer of explosive material has graded perforations. Of these panel arrangements, the embodiments of FIGS. 22 to 24 have two layers of explosive material in which one layer, which at least partially overlies the other layer, is provided with graded rows of perforations. In the panel arrangements shown in FIGS. 25 and 26 there is but a single layer of explosive material having row graded perforations.

Figure 27:
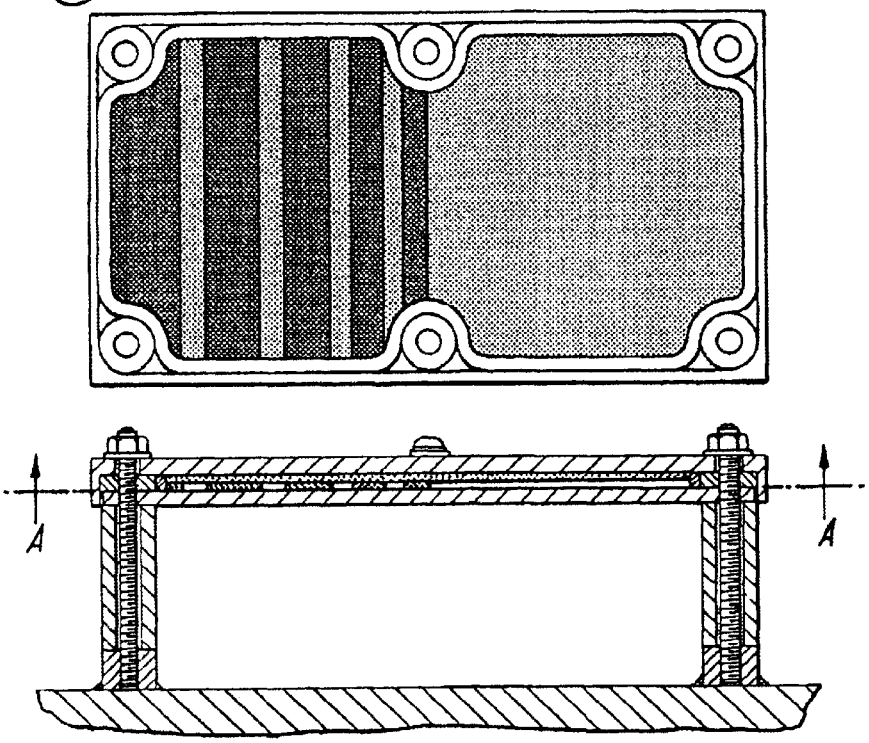
FIG. 27 is an assembly view of an ERA panel, showing a full layer of explosive material, lightly shaded, with further strips of explosive material shown darker.
Figure 28:
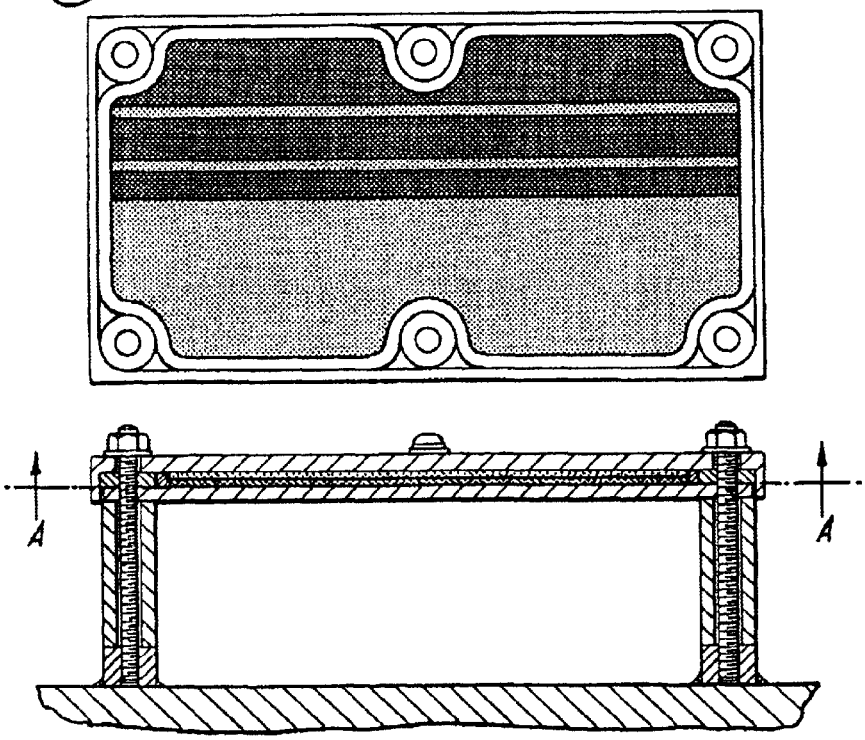
FIG. 28 is an assembly view of an ERA panel, showing a full layer of explosive material lightly shaded, with further strips of explosive material shown darker in which the width of the strips are gradually decreased towards the centre of the panel.
Figure 29:
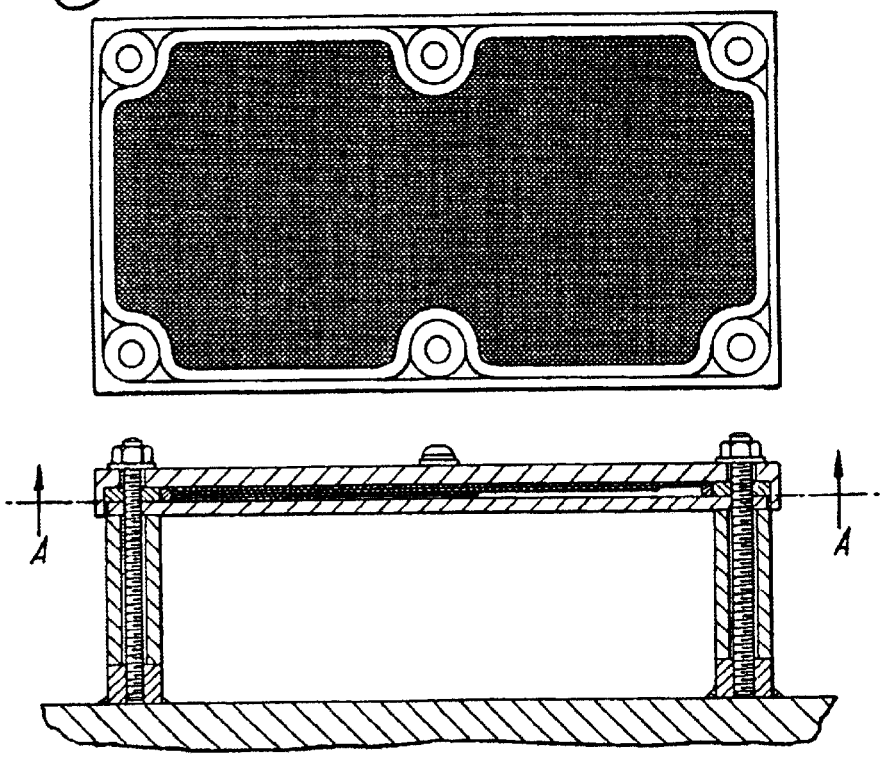
FIG. 29 is an assembly view of an ERA panel showing a layer of explosive material, tapered over its length, shaded.

In the panel arrangements shown in FIGS. 27 and 28 two layers of explosive material are included in which the additional layer is in the form of discrete transverse or longitudinally extending strips in which successive strips are of reducing width towards the centre of the panel.

The embodiments of FIGS. 29 to 32 all have only a single layer of explosive material. In the panel arrangements of FIGS. 29 and 30 the layer of explosive material is tapered in cross-section so that it decreases in thickness in a direction extending from one edge of the panel to an opposite edge of the panel.

Figure 31:
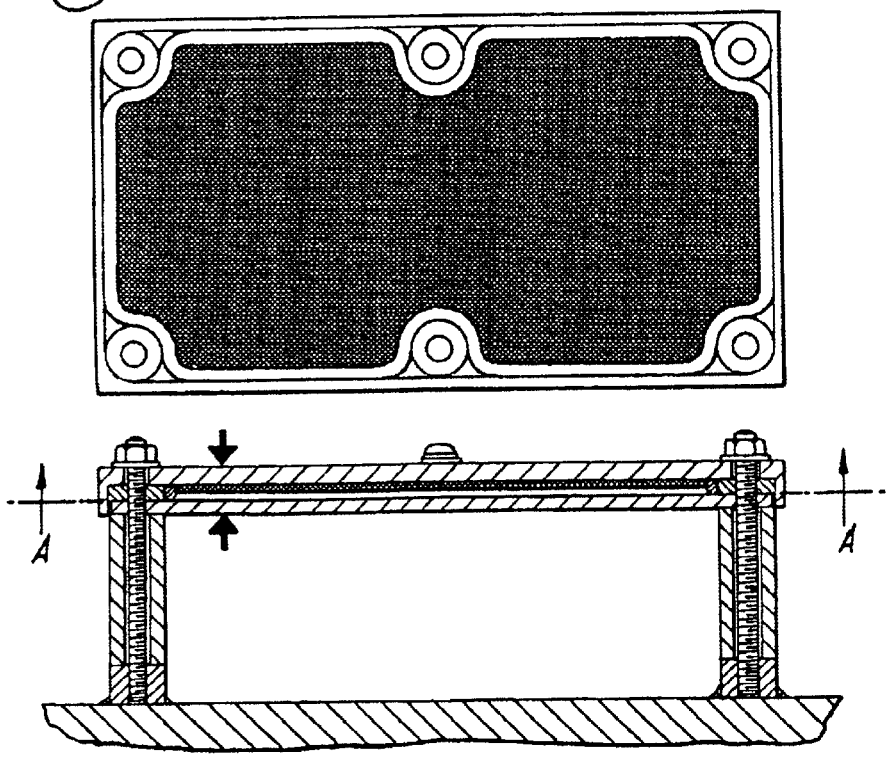
FIG. 31 is an assembly view of an ERA panel, showing a full layer of explosive material, shaded, with the exterior and interior plates mechanically restrained, towards one end.

In the panel arrangements of FIGS. 31 and 32 the single layer of explosive material is substantially of uniform thickness but the plates at one edge of the panel are mechanically restrained by suitable means from being driven apart upon reactive explosion as readily as the plates at an opposite edge of the panel. It is envisaged that such mechanical restraint could be used in conjunction with all the other plate arrangements described herein.

What is claimed is:

1. An applique armour panel for fitting to a substrate and for protecting the substrate from projectile attack which panel comprises:

an exterior plate, an interior plate, said plates having juxtaposed faces and at least a first layer of explosive material located at least partially between said plates, [which] said explosive material is detonated by said projectile attack to cause the panel to disrupt the projectile attack by reducing any penetrative effect thereof, said panels and said explosive material comprising a means, upon reactive explosion, for driving the interior and exterior plates apart more rapidly at one edge of the panel than at an opposite edge by at least partially including a rotating moment of one plate relative to the other and for enhancing the disruptive effect upon the projectile attack.

2. An applique armour panel according to claim 1 wherein the layer of explosive material is substantially coplanar with the juxtaposed faces of said interior and exterior plates.

3. An applique armour panel according to claim 2 wherein the layer of explosive material is tapered so that it decreases in thickness in a direction extending from said one edge towards said opposite edge.

4. An applique armour panel according to claim 2 wherein the layer of explosive material is perforate, and in which the size of the perforations graded so that they are of increased size in a direction extending from said one edge towards said opposite edge.

5. An applique armour panel according to claim 4 wherein the perforations are graded in rows.

6. An applique armour panel according to claim 2 wherein an additional layer of explosive material is superposed upon said first layer of explosive material so as to at least partially cover said first layer.

7. An applique armour panel according to claim 6 wherein the additional layer of explosive material is perforate.

8. An applique armour panel according to claim 7 wherein the size of the perforations in said additional layer of explosive material are graded so that they are of increased size in a direction extending from said one edge towards said opposite edge.

9. An applique armour panel according to claim 6 wherein the additional layer of explosive material is in the form of discrete strips.

10. An applique armour panel according to claim 9 wherein said strips are graded so that they are of decreasing width in a direction extending from said one edge towards said opposite edge.

11. An applique armour panel according to claim 1 wherein said panel is substantially rectangular in shape and said one edge is a transverse edge of the panel.

12. An applique armour panel according to claim 1 wherein said panel is substantially rectangular in shape and said one edge is a longitudinal edge of the panel.

13. An applique armour panel for fitting to a substrate and for protecting the substrate from projectile attack which panel comprises:

an exterior plate.

an interior plate, said plates having juxtaposed faces and at least a first layer of explosive material located at least partially between said plates, said explosive material is detonated by said projectile attack to cause the panel to disrupt the projectile attack by reducing any penetrative effect thereof, said panels and said explosive material comprising a means, upon reactive explosion, for driving the interior and exterior plates apart more rapidly at one edge of the panel than at an opposite edge by at least partially including a rotating moment of one plate relative to the other and for enhancing the disruptive effect upon the projectile attack wherein, restraining means are provided to restrain the interior and exterior plates against being driven apart to a lesser degree at said one edge than at said opposite edge.

14. An applique armour panel for fitting to a substrate and for protecting the substrate from projectile attack which panel comprises:

an exterior plate, an interior plate, said plates having juxtaposed faces and at least a first layer of explosive material located at least partially between said plates, said explosive material is detonated by said projectile attack to cause the panel to disrupt the projectile attack by reducing any penetrative effect thereof, said panels and said explosive material comprising a means, upon reactive explosion, for driving the interior and exterior plates apart more rapidly at one edge of the panel than at an opposite edge by at least partially including a rotating moment of one plate relative to the other and for enhancing the disruptive effect upon the projectile attack, wherein the layer of explosive material is substantially coplanar with the juxtaposed faces of said interior and exterior plates, and an additional layer of explosive material is superposed upon said first layer of explosive material so as to at least partially cover said first layer, wherein the additional layer of explosive material is of chevron shape in which the base of the chevron is disposed adjacent said one edge and the apex of the chevron towards, but stops short of, or is disposed adjacent said opposite edge.

* * * * *